United States Patent [19]

Dravnieks et al.

[11] 4,017,025

[45] Apr. 12, 1977

[54] VARIABLE VOLUME CONTROL BOX AND SYSTEM INCORPORATING SAME

[75] Inventors: Konstantins Dravnieks, Madison; Gordon C. Sylvester, Verona, both of Wis.

[73] Assignee: Wehr Corporation, Milwaukee, Wis.

[22] Filed: Jan. 28, 1974

[21] Appl. No.: 436,963

[52] U.S. Cl. ..... 236/49; 236/80 R; 251/61; 251/300; 236/99 A

[51] Int. Cl.[2] ..... F24F 11/04

[58] Field of Search ..... 236/49, 80 R; 98/40 L, 98/40 D, 41 R; 251/299, 300, 301, 61; 181/59

[56] References Cited

UNITED STATES PATENTS

| | | | |
|---|---|---|---|
| 2,278,016 | 3/1942 | Otto | 236/49 |
| 3,101,737 | 8/1963 | Brown | 251/299 X |
| 3,434,409 | 3/1969 | Fragnito | 236/80 X |
| 3,452,667 | 7/1969 | Coleman et al. | 98/41 R |
| 3,465,814 | 9/1969 | Heck et al. | 236/49 X |
| 3,465,962 | 9/1969 | Matulich et al. | 236/80 X |
| 3,506,038 | 4/1970 | Perry et al. | 98/41 X |
| 3,687,364 | 8/1972 | McNabney | 236/49 |
| 3,719,321 | 3/1973 | McNabney | 236/49 |
| 3,750,839 | 8/1973 | McNabney | 98/41 R |
| 3,779,275 | 12/1973 | Ley et al. | 236/49 X |
| 3,804,364 | 4/1974 | De Lepeuere | 251/61 X |
| 3,817,452 | 6/1974 | Dean | 251/61 X |

*Primary Examiner*—William E. Wayner

[57] ABSTRACT

An inlet plenum extends into a control box and opens into the interior of the control box. Conditioned air is introduced into the box through the inlet plenum and flows from the box, to an area being serviced, through an outlet spaced from the plenum opening in the box. A damper is positioned at the plenum opening and it and the plenum at the opening having conforming shapes, i.e., segments of a circle. The damper closes over the discharge opening and, to vary the volume of air flowing through the box, pivots away from the opening about an axis offset from the center of the arc of the damper and the plenum opening. When the damper is closed on the plenum opening, the centers of the arcuate plenum opening and the damper are coincident and, relative to a central plane parallel to air flow through the plenum, are offset from that plane so that the damper is moved away from the plenum opening by air flow. The damper is closed against air flow pressure by inflation of an air bladder, air inflates the bladder being drawn from the air flow through the inlet plenum and the flow of air to the bladder being controlled in accordance with the temperature of the area being serviced and the volume of air flowing from the box. Air flow volume is determined for control purposes by sensing box pressure at the outlet. The interior walls of the box are acoustically treated and, for acoustical purposes, a dead air space is also defined between the discharge opening and the box outlet.

17 Claims, 3 Drawing Figures

Fig. 1
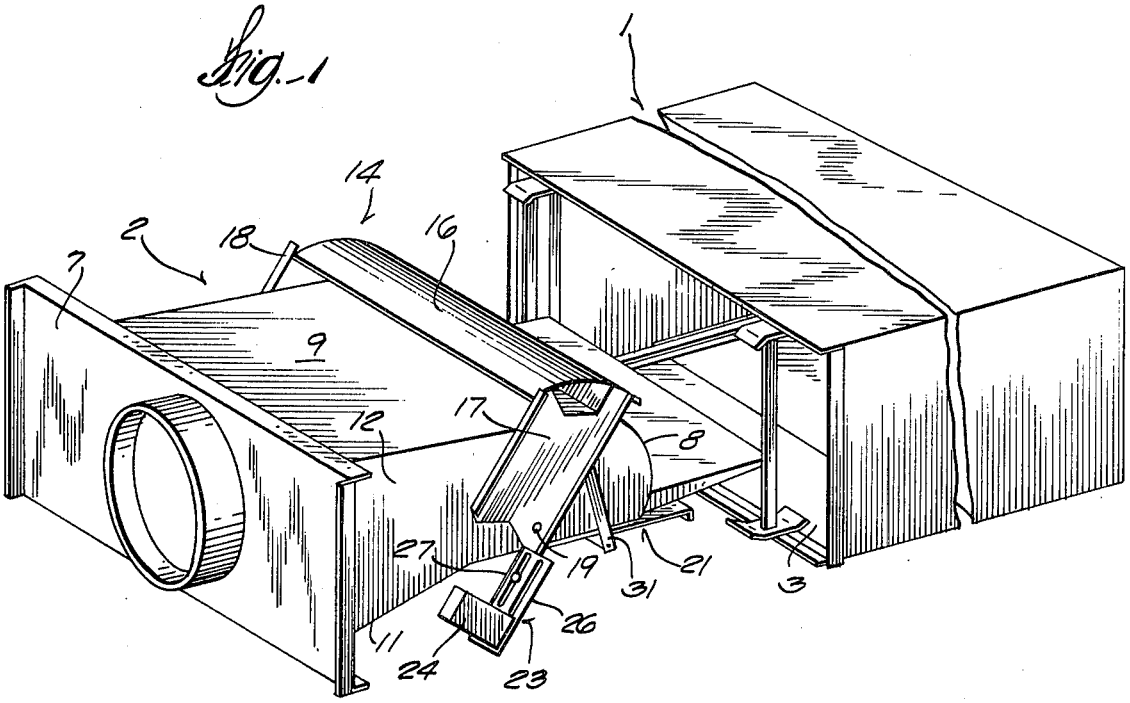
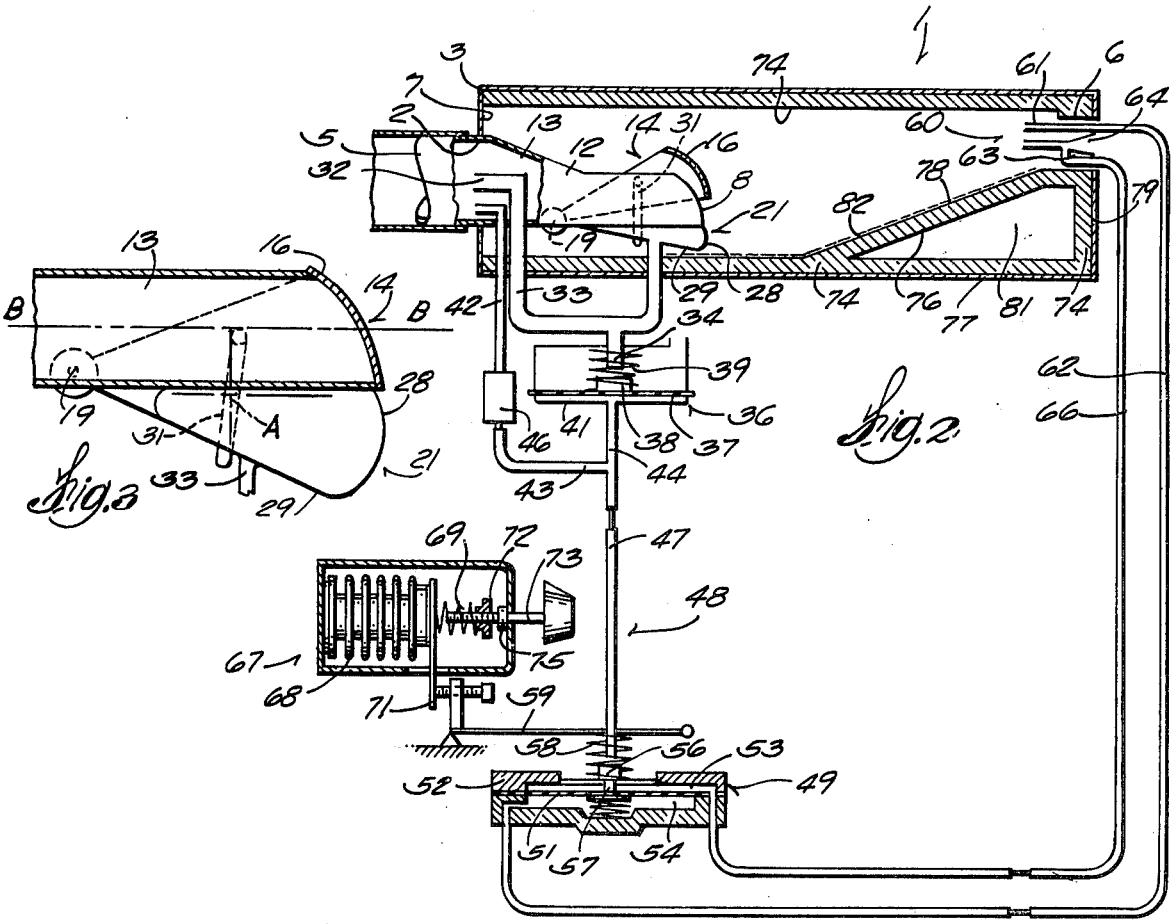
Fig. 2
Fig. 3

VARIABLE VOLUME CONTROL BOX AND SYSTEM INCORPORATING SAME

BACKGROUND OF THE INVENTION

This invention relates to air distribution systems and, more particularly, to an arrangement for controlling the volume of air flow to areas being serviced by such a system.

Variable air volume distribution systems have gained acceptance in the air distribution field. Such systems are adapted to provide different volumes of conditioned air to achieve particular temperatures in areas being serviced, thus the name variable air volume systems. Some systems go a step further and are adapted to provide a constant volume flow of air at that particular volume selected to achieve a given temperature condition. These are referred to in the air distribution field as constant variable volume systems. This invention is concerned with such systems.

SUMMARY OF INVENTION

Among the general objects of this invention is to provide an improved air distribution control box which will provide variable volume distribution.

Another object of this invention is to provide a variable volume air distribution arrangement which also includes a constant volume delivery capability at a given volume selection.

A further object of this invention is to provide an improved damper for an air distribution arrangement and, still further, to provide an improved and simplified arrangement for controlling damper operation.

A still more specific object of this invention is to provide a substantially self-contained variable volume air distribution control box.

For the achievement of these and other objects, this invention proposes an arrangement wherein a control box includes a multi-position damper controlling the volume of air flowing through the box, damper movement in turn being produced by the air flowing through the box. This contributes to the self-contained characteristic of the control box in that actuation of the damper does not need an external source of power. Preferably, the damper is associated with an opening through which air is introduced into the interior of the control box. The damper can assume a position closing the opening and is movable to uncover the opening in various degrees to permit different volumes of air to flow past the damper. More specifically, the damper is normally biased in one direction relative to the opening (i.e., toward an open or closed position) and is moved against the bias by an air operated actuator, the air for operating the actuator being drawn from that flowing through the control box. In a preferred arrangement, the damper is generally arcuate and, in closing, registers with a similarly shaped structure at the opening through which air is introduced into the control box. The centers about which the arcuate surfaces of the damper and the opening are generated are eccentrically located relative to the air flow through the opening and are offset from the pivot about which the damper moves relative to the opening. The eccentricity provides a two-fold function, the damper is displaced laterally away from the opening as it leaves its fully closed positions and moves toward its fully open position. The results in opening or closing movement of the damper without the need for overcoming friction as would otherwise be present if the damper were to slide over the surface defining the opening. In addition, the eccentricity permits the flowing air impinging on the damper to provide the bias normally acting on the damper.

In a preferred arrangement, the degree of damper actuator operation is controlled in accordance with the temperature selected in the area being serviced and, in addition, in accordance with the volume of air flow from the control box. This achieves variable volume distribution with constant volume operation at a selected control point.

The interior walls of the control box are acoustically treated and, for acoustical purposes, a dead air space is provided behind an angular wall sloping from the opening to an outlet in the control box.

Sensors responsive to the pressure, and correspondingly the flow volume, are provided at the outlet and are used to provide the control parameter upon which bladder inflation is related to flow volume.

Other objects and advantages will be pointed out in, or be apparent from, the specification and claims, as will obvious modifications of the embodiment shown in the drawings, in which:

FIG. 1 is a perspective view of a control box embodying this invention;

FIG. 2 is a generally schematic longitudinal section view through the control box and including a schematic illustration of the damper control arrangement; and FIG. 3 is a side view of the inlet plenum illustrating structural details of the damper and its association with the inlet plenum.

DESCRIPTION OF PREFERRED EMBODIMENT

Generally, systems of the type to which this invention relates are used in applications wherein the interior of the building or other structure, is heated by the electric lighting, and to a lesser degree by people and other electrical equipment and appliances in the building. Cold air is delivered to the interior areas to cool those areas virtually year-round and this invention will be described as though incorporated in such an application. It is to be appreciated, however, that the system could be used to deliver hot air and in other types of applications.

With particular reference to the drawings, the preferred embodiment is illustrated as incorporating a control box 1. The control box carries an inlet plenum 2 at one of its ends 3 and, the plenum includes a collar 4 for attachment to a flexible duct 5, or the like, in connecting the box into the air delivery system. The interior 4 of the box is generally open and the box includes an outlet opening 6 which, in a conventional manner, is connected to the diffuser, or the like, through which air is delivered into the room or other area being serviced. Inlet plenum 2 includes an end plate 7 from which collar 4 projects and which covers the end 3 of the control box. The main portion of plenum 2 extends into the interior of the control box and terminates in an open end 8. More specifically, plenum 2 includes top and bottom walls 9 and 11 and side walls 12 and 13. These walls define an open plenum from collar 4 to inlet plenum opening 8 so that air is directed to the interior core of the box through the inlet plenum and flows out through outlet 6.

In order to control the volume of air being discharged into the box, a damper assembly 14 is mounted on the inlet plenum. More particularly, the assembly includes a damper 16 and a pair of support arms 17 and 18 extending from the damper along sides 12 and 13 of the inlet plenum. Sides 17 and 18 are connected to the inlet plenum on pins 19, one such pin extending through both plenum side walls 12 and 13 but only one pin illustrated in the drawings. These pins define an axis about which damper assembly 14 pivots relative to plenum opening 8.

Preferably, damper 16 is generally arcuate in transverse cross section specifically a segment of a circle. The ends of side walls 12 and 13 which define opening 8 are also arcuate having a shape the same as that of damper 16. The damper assembly moves about pins 19 to close on the surfaces defining opening 8 to seal the opening. The damper is also movable from that closed position to vary the degree of opening of the inlet plenum to the plenum to the control box and thereby vary the volume of air flowing into the control box.

An actuator assembly 21 is also mounted on the inlet plenum to control the movement of damper assembly 14. In general terms, it is preferable that the damper assembly be biased toward either its position closed on opening 8 or towards its full open position and that actuator assembly 21 operate against the bias to move the damper assembly. It will be appreciated that the use of the term biased in this application encompasses various means of achieving a bias such as a spring, gravity, or as will be described hereinafter the pressure of air flow through the inlet plenum.

With damper 16 being arcuate, it is possible to mount it such that its pivot axis 19 is eccentric relative to the air flow through the plenum. In the illustrated embodiment and as viewed in FIG. 3, when the damper is closed on inlet plenum opening 8 the centers about which the damper and the surfaces defining 8 are generated are coincident (point A) and offset from axis 19. Also, relative to a central plane B—B through the inlet plenum and parallel to the direction of air flow, the centers A and pivot axis 19 are located below the plane. With the eccentric arrangement of the damper, air flow through the inlet plenum has the effect of creating a pressure on damper 16 tending to swing it open. This air pressure provides the bias referred to above and urges the damper away from its closed position and towards its full open position.

To minimize the forces necessary to open damper 16 a counterweight assembly 23 is attached to each side arm 17 and 18, only one such a counterweight assembly is illustrated in FIG. 1 as both are identical (for simplicity the counterweight assemblies have been eliminated in FIGS. 2 and 3). Each counterweight assembly includes a body 24 and a plate 26 with a pin and slot connection 27 to arm 17. This pin and slot connection allows the counterweight assembly to be adjusted to balance out the weight of the side arms and damper 16. If desired, the counterweight assembly can be so adjusted that it does not fully balance the weight of the side arms and the damper so that when the air pressure is removed the damper will swing closed on opening 8.

Actuator assembly 21 includes an air bladder 28 attached to plate 29 which is in turn affixed to bottom wall 11 of the inlet plenum and free to pivot with respect to that wall. Connecting arms 31 extend from both side arms 17 and 18 of the damper assembly and provide the connection between plate 29 and the damper assembly. Inflation of bladder 28 moves damper 16 towards its position closed on opening 8. Preferably the air for inflating bladder 28 is drawn from that passing through inlet plenum 2. This is accomplished by providing an air pick-up 32 in the inlet plenum, the pick-up being connected to the air bladder by flexible conduit 33. The amount of air which is allowed to flow through air bag 28 is controlled in a manner to be described hereinafter but, it will be appreciated from the description to this point, that air flowing through conduit 33 provides a force reacting with the air pressure acting on damper 16 and the balance, or unbalance, of this force and the bias of air pressure determines the damper position.

The amount of air being transmitted to bladder 28 can be controlled in a number of ways, a preferred control arrangement being illustrated in FIG. 2.

With specific reference to FIG. 2 wherein a control arrangement for the bladder actuator is schematically illustrated, a bleed port 34 is provided in conduit 33 and bleed port control 36 includes a conventional flexible diaphragm 37 carrying a bleed port plug 38. Compression spring 39 provides a biasing force on diaphragm 37 and a chamber 41 is defined beneath the diaphragm. Chamber 41 communicates with the air flow in inlet plenum 2 through conduits 42, 43, and 44. An adjustable restrictor 46 is provided between conduits 44 and 43 to provide a measure of control of the pressure which exists in chamber 41. The pressure in chamber 41 reacts with spring 39 to vary the position of plug and the amount bleed port 34 is open and therefore the amount of air being delivered to bladder 28. A control arrangement 48 in FIG. 2 includes a pressure responsive assembly 49 including a conventional diaphragm 51 dividing a body 52 into chambers 53 and 54. A second bleed port plug 56 is connected to diaphragm 51 through post 57, and moves with the diaphragm.

Diaphragm 51 will move in accordance with the pressure differential between chambers 53 and 54 which reacts against compression spring 58 seated between lever 59 and bleed port plug 56.

Chambers 53 and 54 are connected to respond to the pressure within control box 1. More particularly, differential pressure sensors 60 are positioned at outlet 6, one such pressure sensor 61 is a standard pick-up connected by conduit 62 to chamber 54. The other pressure sensor 63 includes a venturi section 64 which produces a reduced pressure which is transmitted through conduit 66 to chamber 53. This combination provides a differential pressure based on the pressure, and correspondingly the flow volume, at outlet 6. Should further details of the venturi sensor be necessary reference is hereby made to the co-pending application of Gordon Sylvester entitled "Flow Monitoring Arrangement," Ser. No. 345,864, filed Mar. 29, 1973, now U.S. Pat. No. 3,889,536 and assigned to the assignee of this invention. It is believed that the above description of the differential pressure sensor should be sufficient for purposes of understanding this invention.

The bias force provided by spring 58 can be adjusted by pivoting lever 59. In order to afford temperature response in control 48 lever 59 is used in associated with a temperature responsive assembly 67 which includes a charged bellow 68 which reacts against a compression spring 69. A lever 71 is positioned between bellows 68 and 69 transmits motion of the combination of bellows-spring to lever 59 to establish the position of lever 59 and the bias force of spring 58. Spring 69 has an adjustment consisting of a threaded shoulder 72 engaged on an adjustment screw 73. Screw 73 is anchored at 75 so that upon rotation of screw 73 the screw does not move axially but shoulder 72 does to vary the bias force provided by spring 69 on lever 71. In a conventional manner, screw 73 can be associated with a standard thermostat calibration to provide an initial temperature setting. Control assembly 58 can be positioned in the room or area to be serviced by the control box so that the volume of air flowing through the control box is determined by the temperature selected for the room by screw 73 and then is controlled, by assembly 49, in accordance with the actual flow volume through the control box.

In operation, air is introduced into inlet plenum 2, the air pressure acts on damper 16 and moves damper 16 open depending upon the degree of inflation of bladder 28. By regulating the amount of air delivered from the inlet plenum to the bladder the degree of damper opening can be set to admit a particular volume of air flow into control box 1 for discharge through outlet 6 so as to maintain a particular desired temperature in the area being serviced.

With the illustrated control arrangement, the desired temperature setting is selected through adjustment of screw 73 by establishing the bias force of spring 69 reacting against bellows 68. The bellows responds to the ambient temperature in the room and, this combination establishes the bias force provided by compression spring 58 acting against diaphragm 51. The system will stabilize at a particular amount of air being bled through port 47 to establish a pressure conditiion in chamber 41, and accordingly a degree of air being bled from conduit 43, so that bag 28 is inflated to that degree necessary to produce the volume of air flow into the box and out of outlet 6 to achieve the selected temperature. Should the volume of air flowing into inlet plenum 2 either increase or decrease, this will result in an increased or decreased pressure at outlet 6 which is sensed by the pressure differential sensors 60 and fed back to chambers 53 and 54 to adjust plug 56 accordingly. In the case of an increased air flow which will have had the tendency of opening damper 16 wider and thereby increasing the volume of air flowing from inlet 6, the plug 56 will be moved toward bleed port 47 reducing the amount of air which is bled from conduit 43 increasing the pressure in chamber 41 and in turn closing off bleed port 34 allowing more air to be delivered to air bag 28. This will increase the inflation of the bladder and move damper 16 against the air pressure towards a closed position to reduce the volume to that volume necessary to maintain the selected temperature.

In the case of a decrease in the pressure of the air flowing into inlet 22, the bias from the air pressure acting on damper 16 will be reduced causing the air bladder to move the damper toward a closed position reducing the volume of air flowing through the box. This reduced air flow results in reduced pressure, and correspondingly reduced volume flow, at outlet 6 and is picked up by differential pressure sensors 60 and relayed to chambers 53 and 54. This change in pressure in chambers 53 and 54 will move plug 56 away from bleed port 47 allowing more air to be bled from conduit 43 reducing the pressure in chamber 41. This will in turn result in plug 38 being moved away from bleed port 34 allowing more air to be bled from conduit 33 and deflating bladder 28 so that the reduced air pressure now presented in inlet plenum 2 will have less resistance from the bladder and can move the damper open to admit more air into the air box and maintain a constant volume flow through outlet 6.

Correspondingly, should bellows 68 sense a temperature change in the room being serviced, it will vary the bias force produced by spring 58, either increasing or decreasing that bias depending on whether there is an increase or decrease in temperature. With an increased temperature plug 56 moves away from bleed port 47 or with a decreased temperature moves the plug toward bleed port 47 to either increase or decrease the amount of air being bled from conduit 43. This in turn will vary the pressure in chamber 41 and the amount of air being bled from conduit 33 through bleed port 43 to either further inflate bladder 28 in the case of an increased temperature sensed by bellows 68 or deflate the bladder in response to an increase temperature sensed by the bellows to move damper 16 away from or towards its closed position, respectively, to increase or decrease the air furnished to the room to compensate for the temperature variation.

In summary, the overall system will provide a variable volume delivery of air through outlet 6 to the area being serviced so that a particular temperature selected at the thermostatic assembly 67 can be maintained. The overall system is further functional to maintain a constant volume of air flow at that particular volume necessary to maintain the particular temperature selected.

An additional advantage results from the eccentric relationship of the damper relative to the axis about which the damper pivots. The damper 16 closes closely on the surfaces defining opening 8 to effectively seal off the air flow through the plenum. In pivoting to open opening 8, damper 16 moves laterally away from the surfaces, as opposed to sliding over those surfaces, as well as moving in the direction of those surfaces. In order words and as viewed in the drawing, as the damper moves up it also moves out and to the right away from side walls 12 and 13. Thus, no friction exists between the damper 16 and the plenum which must be overcome in opening and closing the damper.

For acoustical purposes, all of the interior walls of the control box are lined with acoustical material 74. Moreover, an angular wall 76 slopes from bottom wall 77 toward outlet 6 and is also covered with acoustical material 78. This wall cooperates with front wall 79 and bottom wall 77 to create a dead air space 81 which further contributes to the acoustical condition achieved in the control box.

A perforated plate 82 extends over angular wall 78 and a portion of bottom wall 77, extending up to a point generally in overlapping relationship with the end of inlet plenum 2 again for acoustical purposes.

Although but one embodiment of the present invention has been illustrated and described, it will be apparent to those skilled in the art that various changes and modifications may be made therein without departing from the spirit of the invention or from the scope of the appended claims.

We claim:

1. A control box for use in an air distribution system and comprising, in combination, plenum means defining an inlet to the interior of said box, means defining an outlet spaced from said inlet so that air flows through said box from said inlet to said outlet, a damper positioned at said inlet, means mounting said damper to assume a first position closed on said inlet and for movement away from said first position to open said inlet, means biasing said damper in one direction of movement relative to said first position, air operated actuator means connected to said damper for moving said damper against said bias and opposite to said one direction of movement, means for exposing said actuator means to the flow of air into said plenum means so that said actuator means is operated by air flowing into said plenum means, said damper being generally arcuate in transverse cross section and said plenum means further defining an arcuate surface corresponding to the arcuate shape of said damper with said arcuate surface defining said inlet, said damper closing on said arcuate surface to close said inlet, and said mounting means defining an axis about which said damper moves in moving toward and away from said first position, the centers about which said arcuate surfaces of said damper and arcuate surface are generated being offset from said axis.

2. The combination of claim 1 wherein said means for exposing said actuator means to said air flow includes a pick-up portion in said plenum means directed into the flow of air into said plenum means, including conduit means connecting said pick-up portion to said actuator means so that a portion of the air flowing into the plenum means flows into said pick-up portion through said conduit means to said actuator means and said actuator means positions said damper in accordance with the air flow to said actuator means, and including means connected to said conduit means for varying the amount of air flowing from said pick-up portion to said actuator means.

3. The combination of claim 2 wherein said actuator means includes an inflatable bladder and means connecting said bladder to said damper to move said damper against said bias and position said damper in accordance with the degree of inflation of said bladder.

4. The combination of claim 1 wherein the centers about which said arcuate surfaces of said damper and arcuate surface are generated are offset from a plane centrally located relative to air flow in said plenum means.

5. The combination of claim 1 wherein, when said damper is closed on said arcuate surface, said centers are coincident.

6. The combination of claim 1 wherein said means for exposing said actuator means to said air flow includes a pick-up portion in said plenum means directed into the flow of air into said plenum means, including conduit means connecting said pick-up portion to said actuator means so that a portion of the air flowing into the inlet flows into said pick-up portion through said conduit means to said actuator means and said actuator means positions said damper in accordance with the air flow to said actuator means, and including means connected to said conduit means for varying the amount of air flowing from said pick-up portion to said actuator means.

7. The combination of claim 1 wherein said plenum means comprises an inlet plenum projecting into said box and terminating within said box in said arcuate surface, and said damper is mounted on said inlet plenum.

8. The combination of claim 7 wherein said actuator means includes an inflatable bladder and means connecting said bladder to said damper to move said damper against said bias and position said damper in accordance with the degree of inflation of said bladder.

9. The combination of claim 8 including control means connected to and operative to control said means for varying said amount of air flowing to said bladder, and said control means including temperature responsive means, pressure responsive means, and means connecting said pressure responsive means to the air flow through said outlet so that said control means varies the flow of air to said bladder on the basis of a selected temperature condition ambient said temperature responsive means and the volume of flow through said outlet.

10. The combination of claim 9 wherein said means for varying said amount of air flowing to said bladder includes a bleed port, communicating with said conduit means, and wherein said control means is operative to vary the degree of opening of said bleed port.

11. The combination of claim 1 wherein said box is generally rectangular in cross section, including acoustical material covering the inner surface of the walls of said box, including an angular wall within said box disposed at an angle to the walls of said box and sloping from a position adjacent said inlet to said outlet, and wherein said angular wall defines, with the walls of said box, a triangular in cross section air space between said inlet and outlet and isolated from the air flow through said box.

12. The combination of claim 11 including a perforated plate extending over said angular wall and over which air passes in flowing from said inlet to said outlet.

13. A control for use in an air distribution system and comprising, in combination, plenum means for connection in said air distribution system, a damper positioned in said plenum means and being generally arcuate in transverse cross section, means defining a control opening in said plenum means through which air flows and including an arcuate surface bordering said control opening and corresponding to the arcuate shape of said damper, means mounting said damper to assume a first position engaging said arcuate surface to close said inlet and for movement away from said first position to open said inlet, means biasing said damper in one direction of movement relative to said first position, means connected to said damper for moving said damper against said bias and opposite to said one direction of movement, and said mounting means defining an axis about which said damper moves in moving toward and away from said first position, the centers about which said arcuate surfaces of said damper and the arcuate surfaces are generated being offset from said axis.

14. The combination of claim 13 wherein the centers about which said arcuate surfaces of said damper and arcuate surfaces are generated are offset from a plane centrally located relative to air flow in said plenum means.

15. The combination of claim 13 wherein, when said damper is closed on said arcuate surface, said centers are coincident.

16. A control box for use in air distribution system and comprising, in combination, plenum means defining an inlet to the interior of said box, means defining an outlet spaced from said inlet so that air flows through said box from said inlet to said outlet a damper positioned at said inlet, means mounting said damper to assume a first position closed on said inlet and for movement away from said first position to open said inlet, means biasing said damper in one direction of movement relative to said first position, air operated actuator means connected to said damper for moving said damper against said bias and opposite to said one direction of movement, means for exposing said actuator means to the flow of air into said plenum means so that said actuator means is operated by air flowing into said plenum means, said box being generally rectangular in cross section, acoustical material covering the inner surface of the walls of said box, an angular wall within said box disposed at an angle to the walls of said box sloping from a position adjacent the inlet to said outlet, and said angular wall defining, with the walls of said box, a triangular in cross section air space between said inlet and outlet and isolated from the air flow through said box.

17. The combination of claim 16 including a perforated plate extending over said angular wall and over which air passes in flowing from said inlet to said outlet.

* * * * *